US007197265B2

(12) United States Patent
Nishiwaki et al.

(10) Patent No.: US 7,197,265 B2
(45) Date of Patent: Mar. 27, 2007

(54) COLOR IMAGE FORMING DEVICES FOR USE IN COLOR PRINTERS

(75) Inventors: Kenjiro Nishiwaki, Nagoya (JP); Masashi Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/376,315

(22) Filed: Mar. 16, 2006

(65) Prior Publication Data

US 2006/0159491 A1 Jul. 20, 2006

Related U.S. Application Data

(62) Division of application No. 11/146,127, filed on Jun. 7, 2005, now Pat. No. 7,046,944, which is a division of application No. 10/146,961, filed on May 17, 2002, now Pat. No. 6,917,777.

(30) Foreign Application Priority Data

May 18, 2001 (JP) ..... 2001-150014

(51) Int. Cl.
*G03G 15/01* (2006.01)
*G03G 15/00* (2006.01)

(52) U.S. Cl. ..... 399/223; 399/162; 399/302

(58) Field of Classification Search ..... 399/302, 399/308, 167, 26, 223, 162
See application file for complete search history.

(56) References Cited

U.S. PATENT DOCUMENTS 4,299,474 A 11/1981 Ernst et al.
5,150,161 A 9/1992 Bujese
5,608,497 A * 3/1997 Haneda et al. ..... 399/223
5,666,599 A 9/1997 Miyasaka et al.
5,742,889 A 4/1998 Tazelaar et al.
5,778,287 A 7/1998 Yu
5,815,775 A 9/1998 Miyasaka et al.
5,946,533 A * 8/1999 Omelchenko et al. ..... 399/223
5,978,626 A 11/1999 Nagamine et al.
6,085,051 A 7/2000 Miyasaka et al.
6,088,565 A 7/2000 Jia et al.

(Continued)

FOREIGN PATENT DOCUMENTS

EP 0 919 881 A2 6/1999

(Continued)

*Primary Examiner*—Susan Lee
(74) *Attorney, Agent, or Firm*—Oliff & Berridge, PLC

(57) ABSTRACT

A color image forming device includes a photosensitive unit, an exposing unit, a plurality of developing units, a first transfer body, a second transfer body and a fixing unit. The photosensitive unit includes a photosensitive member with a photosensitive layer. The exposing unit exposes the photosensitive layer to form a series of latent images on the photosensitive member. Each of the developing units includes a developing-agent bearing member bearing thereon a different color developing agent and supplies the developing agent to the photosensitive member to develop corresponding latent images into visible images. The first transfer body receives the visible images from the photosensitive member. The second transfer body receives transfer of the visible images from the first transfer body and transfers the visible images onto a recording medium. The fixing unit fixes the visible images onto the recording medium.

10 Claims, 5 Drawing Sheets

U.S. PATENT DOCUMENTS 6,337,967 B1 1/2002 Izumi et al.
6,369,842 B1 * 4/2002 Abramsohn ..... 399/162
6,405,002 B2 6/2002 Ogiyama et al.
6,434,355 B1 8/2002 Badesha et al.
6,560,435 B1 5/2003 Yamamoto et al.
6,574,451 B2 6/2003 Miyasaka et al.
6,690,483 B1 2/2004 Ishida
6,697,581 B2 2/2004 Ohtani et al.
2001/0019674 A1 * 9/2001 Asano et al. ..... 399/223

FOREIGN PATENT DOCUMENTS

JP A 05-011565 1/1993
JP A 10-063151 3/1998
JP A 11-311905 11/1999
JP A 2001-092214 4/2001
WO WO 01/22174 A1 3/2001

* cited by examiner

COLOR IMAGE FORMING DEVICES FOR USE IN COLOR PRINTERS

This is a Division of application Ser. No. 11/146,127 filed Jun. 7, 2005 now U.S. Pat. No. 7,046,944, which is a Division of application Ser. No. 10/146,961 filed May 17, 2002 now U.S. Pat. No. 6,917,777. The entire disclosures of the prior applications are incorporated by reference.

BACKGROUND OF THE INVENTION

This invention relates to an image forming device such as color laser printer or color LED printer.

A well-known color laser printer for forming a color image includes a plurality of developing devices, a photosensitive belt, an intermediate transfer body, and a fixing unit. Each developing device stores a different color of toner and includes a developing roller. The photosensitive belt bears a visible image developed by the color of toner supplied from the corresponding developing roller. The intermediate transfer body receives transfer of individual monochrome images from the photosensitive belt one at a time. The monochrome images are superimposed one on top of the other to produce a multi-color image borne on the intermediate transfer body. The intermediate transfer body transfers the multi-color image onto a sheet. The fixing unit fixes the multi-color image onto the sheet.

SUMMARY OF THE INVENTION

A color image forming device according to the present invention includes a housing, a photosensitive unit, an exposing unit, a plurality of developing units, a transfer unit, and a fixing unit. The housing has a recording medium discharge opening adapted to discharge recording media from the housing in a forward direction. The photosensitive unit includes a photosensitive member with a photosensitive layer. The exposing unit exposes the photosensitive layer based on a multi-color image to form a series of latent images on the photosensitive member. The developing units are provided within the housing in a forward portion of the housing with respect to the photosensitive unit. Each of the developing units includes a developing-agent bearing member bearing thereon a different color developing agent and supplies the developing agent to the photosensitive member to develop corresponding latent images into visible images. The transfer unit receives the visible images from the photosensitive member and transfers the visible images onto a recording medium. The fixing unit is provided within the housing in a rear portion of the housing with respect to the photosensitive unit. The fixing unit fixes the visible images onto the recording medium and transports the recording medium toward a recording medium discharge opening.

With this configuration, the sheets are easy for the user to retrieve because they are discharged in the forward direction toward the user. Also, the developing units are easy to exchange because they are provided in the forward portion of the housing, which is the portion nearest to where the user normally faces the printer.

According to a second aspect of the present invention, an image forming device includes a photosensitive unit including a photosensitive member with a photosensitive layer; an exposing unit that exposes the photosensitive layer based on a multi-color image to form a series of latent images on the photosensitive member; a plurality of developing units each including a developing-agent bearing member that is disposed in contact with the photosensitive member, the photosensitive member and the developing-agent bearing members all moving downward at contact positions where the developing-agent bearing members contact the photosensitive member, each developing-agent bearing member bearing thereon a different color developing agent and supplying the developing agent to the photosensitive member at the contact positions to develop corresponding latent images into visible images; a first transfer body that receives transfer of the visible images borne on the photosensitive member; a second transfer body that receives transfer of the visible images from the first transfer body and that transfers the visible image onto a recording medium; and a fixing unit that fixes the visible images onto the recording medium.

According to a third aspect of the present invention, an image forming device includes a photosensitive unit including a photosensitive member with a photosensitive layer; an exposing unit that exposes the photosensitive layer based on a multi-color image to form a series of latent images on the photosensitive member; a plurality of developing units each including a developing-agent bearing member that is disposed in contact with the photosensitive member, the photosensitive member moving upward and the developing-agent bearing members all moving downward at contact positions where the developing-agent bearing members contact the photosensitive member, each developing-agent bearing member bearing thereon a different color developing agent and supplying the developing agent to the photosensitive member at the contact positions to develop corresponding latent images into different-colored monochrome visible images; an intermediate transfer belt that receives the different-colored monochrome visible images one at a time from the photosensitive member in an overlapping manner to bear a multi-color image, the intermediate transfer belt transferring the multicolor image onto a recording medium; and a fixing unit that fixes the multi-color image onto the recording medium, the fixing unit being disposed on the opposite side of the photosensitive member than the developing-agent bearing members.

According to a fourth aspect of the present invention, an image forming device includes a photosensitive unit including a photosensitive member with a photosensitive layer; an exposing unit that exposes the photosensitive layer based on a multi-color image to form a series of latent images on the photosensitive member; a plurality of developing units each including a developing-agent bearing member that is disposed in contact with the photosensitive member, the photosensitive member and the developing-agent bearing members all moving upward at positions where the developing-agent bearing members contact the photosensitive member, each developing-agent bearing member bearing thereon a different color developing agent and supplying the developing agent to the photosensitive member to develop corresponding latent images into different-colored monochrome visible images; an intermediate transfer belt that receives the different-colored monochrome visible images one at a time from the photosensitive member in an overlapping manner to bear a multi-color image, the intermediate transfer belt transferring the multicolor image onto a recording medium; and a fixing unit that fixes the multi-color image onto the recording medium, the fixing unit being disposed on the opposite side of the photosensitive member than the developing-agent bearing members.

According to a fourth aspect of the present invention, an image forming device includes a photosensitive unit including a photosensitive member with a photosensitive layer; an exposing unit that exposes the photosensitive layer based on a multi-color image to form a series of latent images on the photosensitive member; a plurality of developing units each including a developing-agent bearing member that is disposed in contact with the photosensitive member, the developing-agent bearing members including at least one developing-agent bearing member that is disposed on one side of the photosensitive member and at least one developing-agent bearing member that is disposed on the opposite side of the photosensitive member, the photosensitive member and the developing-agent bearing member that is disposed on the opposite side of the photosensitive member both moving upward at positions where the photosensitive member and the developing-agent bearing member that is disposed on the opposite side of the photosensitive member contact each other, each developing-agent bearing member bearing thereon a different color developing agent and supplying the developing agent to the photosensitive member to develop corresponding latent images into different-colored monochrome visible images; an intermediate transfer belt that receives different-colored monochrome visible images one at a time from the photosensitive member in an overlapping manner to bear a multi-color image, the intermediate transfer belt transferring the multicolor image onto a recording medium; and a fixing unit that fixes the multi-color image onto the recording medium, the fixing unit being disposed to one side of the photosensitive member, wherein the photosensitive member and the developing-agent bearing member that is disposed on the same side of the photosensitive member as the fixing unit both move downward where the photosensitive member and the developing-agent bearing member that is disposed on the same side as the fixing unit contact each other.

According to a fifth aspect of the present invention, an image forming device includes a photosensitive unit including a photosensitive member with a photosensitive layer; an exposing unit that exposes the photosensitive layer based on a multi-color image to form a series of latent images on the photosensitive member; a plurality of developing units each including a developing-agent bearing member that is disposed in contact with the photosensitive member, the developing-agent bearing members including at least one developing-agent bearing member that is disposed on one side of the photosensitive member and at least one developing-agent bearing member that is disposed on the opposite side of the photosensitive member, the photosensitive member moving upward and the developing-agent bearing member that is disposed on the opposite side of the photosensitive member moving downward at positions where the photosensitive member and the developing-agent bearing member that is disposed on the opposite side of the photosensitive member contact each other, each developing-agent bearing member bearing thereon a different color developing agent and supplying the developing agent to the photosensitive member to develop corresponding latent images into different-colored monochrome visible images; an intermediate transfer belt that receives different-colored monochrome visible images one at a time from the photosensitive member in an overlapping manner to bear a multi-color image, the intermediate transfer belt transferring the multicolor image onto a recording medium; and a fixing unit that fixes the multi-color image onto the recording medium, the fixing unit being disposed to one side of the photosensitive member, wherein the photosensitive member and the developing-agent bearing member that is disposed on the same side of the photosensitive member as the fixing unit both move downward where the photosensitive member and the developing-agent bearing member that is disposed on the same side as the fixing unit contact each other.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENT

Color laser printers according to different embodiments of the present invention will be described with reference to the attached drawings. Unless otherwise noted, directional expressions such as "front", "rear", "above" and "below" are used throughout the description to define the various parts when the printers are disposed in an orientation in which they are intended to be used.

Figure 1:
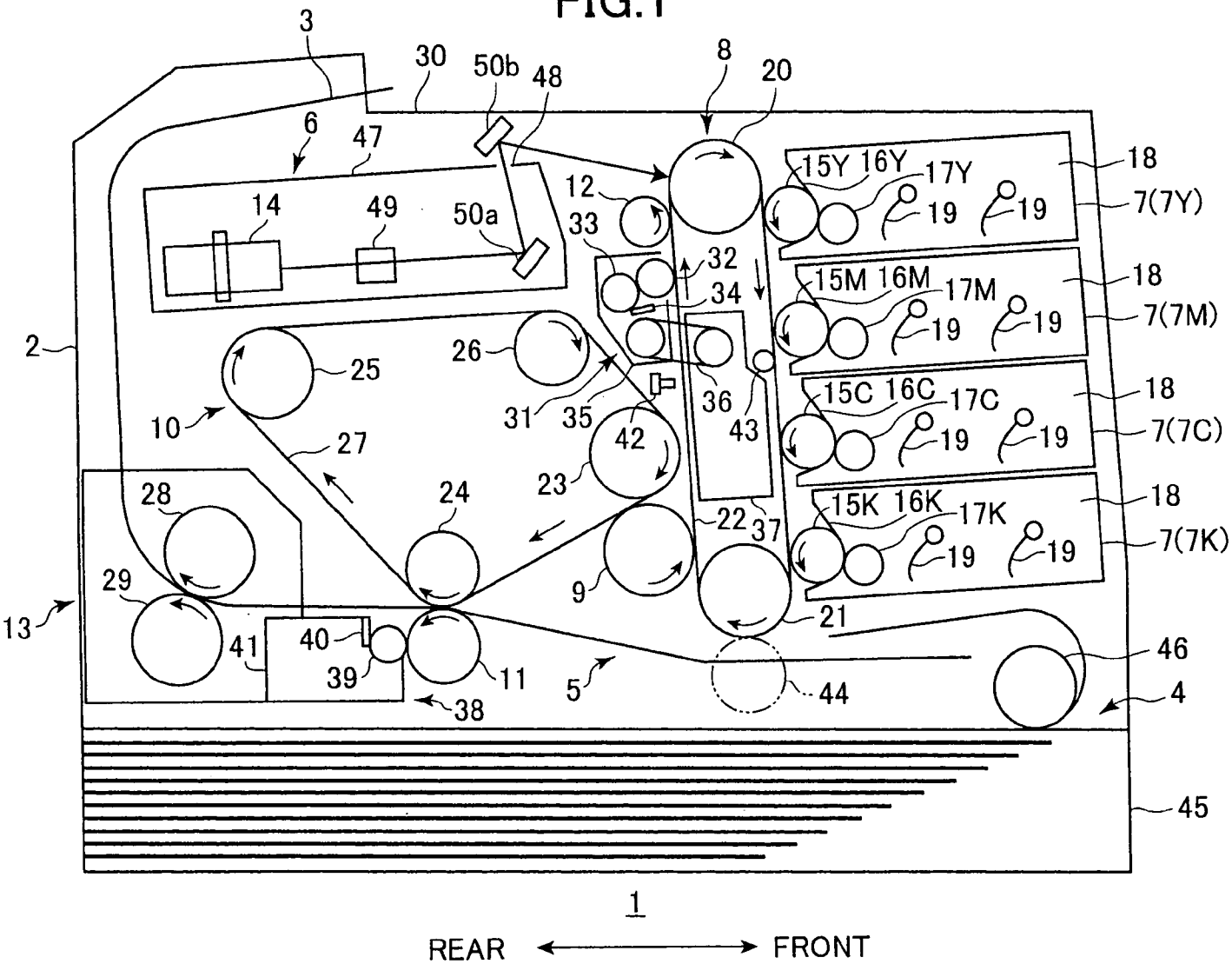
FIG. 1 is a cross-sectional view showing a color laser printer according to a first embodiment of the present invention.

FIG. 1 is a sectional side view showing a color laser printer according to a first embodiment of the present invention. The laser printer 1 comprises a housing 2, a sheet-supply unit 4 for supplying sheets 3, and an image-forming unit 5 for forming a predetermined image on the supplied sheet.

The sheet-supply unit 4 includes a sheet-supply tray 45 and a sheet-supply roller 46. Sheets 3 are stacked in the sheet-supply tray 45 of the sheet-supply unit 4. Sheets are fed out one at a time from the top of the stacked sheets by a sheet-supply roller 46 to the image-forming unit 5.

The image-forming unit 5 includes a scanner unit 6, four developing cartridges 7, a photosensitive belt mechanism 8, a first transfer roller 9, a second transfer belt mechanism 10, a third transfer roller 11, a charging roller 12, and a fixing unit 13.

The scanner unit 6 is located in the rear side of the housing 2 at a position over the secondary transfer belt mechanism 10. The scanner unit 6 includes a laser beam emitter (not shown), a polygon mirror 14 driven to rotate, a lens 49, and a reflecting mirror 50*a* in a scanner housing 47. The scanner housing 47 is mounted substantially parallel to an upper surface of a second transfer belt 27 of the second transfer belt mechanism 10. The scanner housing 47 has an opening 48 in its upper-rear surface. The scanner unit 6 further includes a reflecting mirror 50*b* disposed above the opening 48. When the scanner unit 6 operates, the laser beam emitter emits a laser beam based on image data. As indicated by the arrow in FIG. 1, the laser beam reflects off the polygon mirror 14, passes through the lens 49, reflects off the reflecting mirror 50*a* to exit the scanner housing 47 through the hole 48. The laser beam further reflects off the reflecting mirror 50*b* to impinge on a surface of a photosensitive belt 22 in the photosensitive belt mechanism 8.

Because the opening 48 is located opposite to the surface facing the second transfer belt 27 of the second transfer belt mechanism 10, toner can be effectively prevented from entering into the scanner housing 47.

The developing cartridges 7 consist of a yellow developing cartridge 7Y containing yellow toner, a magenta developing cartridge 7M containing magenta toner, a cyan developing cartridge 7C containing cyan toner, and a black developing cartridge 7K containing black toner. The developing cartridges 7 are positioned in the front portion within the housing 2, aligned in parallel with each other, one on top of the other separated from each other by a certain spacing.

All of the developing cartridges 7Y, 7M, 7C, and 7K have substantially the same configuration, so a single developing cartridge 7 will be described as representative example. The developing cartridge 7 includes a developing roller 15, a layer-thickness regulating blade 16, a feed roller 17, and a toner container 18. The developing roller 15 is horizontally movable into and out of contact with the surface of the photosensitive belt 22.

Each toner container 18 holds a positively-charging non-magnetic, single-component toner in a corresponding one of colors of yellow, magenta, cyan, and black. Each toner container 18 includes two agitators 19 separated by a predetermined distance in the front-to-rear direction. Rotation of the agitators 19 effectively circulates toner in the toner containers 18 and supplies the toner to the feed roller 17.

In each developing cartridge 7, the feed roller 17, and the developing roller 15 are rotatable in pressing contact with each other to a certain extent. The developing roller 15 rotates counterclockwise so that its surface moves downward where it contacts the photosensitive belt 22, that is, at the nip portion between the developing roller 15 and the photosensitive belt 22.

A predetermined developing bias voltage is applied between the developing roller 15 and the photosensitive belt 22. In addition, the layer-thickness regulating blade 16 presses against an upper part of the feed roller 17, that is, a surface opposite to the surface facing the photosensitive belt 22.

Rotation of the agitators 19 move toner contained in the toner container 18 to the developing roller 15 by rotation of the feed roller 17. At this time, the toner is positively charged by friction between the feed roller 17 and developing roller 15, and then fed onto the developing roller 15. As the developing roller 15 rotates, the toner is fed into an area between the layer-thickness regulation blade 16 and the developing roller 15. The toner is charged sufficiently by friction between the blade 16 and the developing roller 15. The charged toner is then carried on the developing roller 15 as a thin layer having a predetermined thickness.

The photosensitive belt mechanism 8 is located to the rear of the four developing cartridges 7. The photosensitive belt mechanism 8 includes a photosensitive belt supporting roller 20 next to the yellow developing cartridge 7Y at the top of four cartridges, a photosensitive belt driving roller 21 directly under the photosensitive belt supporting roller 20 and facing the black developing cartridge 7B at the bottom of four cartridges, and an endless photosensitive belt 22 wound around the photosensitive belt supporting roller 20 and the photosensitive belt driving roller 21. The photosensitive belt 22 has a photosensitive layer of organic photosensitive material formed on a surface thereof. The photosensitive belt 22 is mounted so as to extend in a vertical direction to face and contact all of the developing rollers 15.

The photosensitive belt driving roller 21 is provided with a driving gear (not shown). Transmission of power from a motor (not shown) to the driving gear rotates the photosensitive belt driving roller 21 clockwise. This rotation and the interlocked clockwise rotation of the photosensitive belt supporting roller 20 conveys the photosensitive belt 22 clockwise around the photosensitive belt supporting roller 20 and the photosensitive belt driving roller 21. As a result, any particular point on the photosensitive belt 22 moves downward from the top most developing roller 15Y of the yellow developing cartridge 7Y toward the lower-most developing roller 15B of the black developing cartridge 7B. In other words, the photosensitive belt 22 is moved downward at the contact portion (a nip portion) with each developing roller 15. It should be noted that the photosensitive belt mechanism 8 is provided with a tension roller 43 disposed on the opposite side of the photosensitive belt 22 with respect to the developing cartridges 7.

The first transfer roller 9 is formed of resilient material, and positioned in the bottom of the housing 2 in confrontation with the black developing cartridge 7K through the photosensitive belt 8. The first transfer roller 9 has substantially the same diameter as that of the photosensitive belt driving roller 21. The first transfer roller 9 is located adjacent to the photosensitive belt 22 at a position shifted away from the photosensitive belt driving roller 21 so that the first transfer roller 9 does not contact the photosensitive belt 22 where the photosensitive belt 22 contacts the photosensitive belt driving roller 21, that is, so as to prevent contact at the nip portion between the photosensitive belt driving roller 21 and the photosensitive belt 22. The first transfer roller 9 is provided with a driving gear (not shown) having the same number of gear teeth as a driving gear (not shown) of the photosensitive belt driving roller 21. Transmission of power from a motor (not shown) to the driving gear rotates the first transfer roller 9 counterclockwise. As a result, a surface of the first transfer roller 9 moves in the same direction as that of the photosensitive belt 22 where it contacts the photosensitive belt 22.

The second transfer belt mechanism 10 is located below the scanner unit 6 and to the rear of the photosensitive belt mechanism 8. In other words, the second transfer belt mechanism 10 is located at the opposite side of the developing cartridges 7 with respect to the photosensitive belt mechanism 8. The second transfer belt mechanism 10 includes the second endless transfer belt 27 and four rollers, that is, a first belt roller 23, a second belt roller 24, a third belt roller 25, and a forth belt roller 26.

The first belt roller 23 has substantially the same diameter as those of the photosensitive belt driving roller 21 and the first transfer roller 9. The first belt roller 23 is located in contact with the second transfer belt 27 at a position shifted from the first transfer roller 9 so that the first belt roller 23 does not contact the second transfer belt 27 at the same place as where the second transfer belt 27 contacts the first transfer roller 9, that is, at the nip portion between the first transfer roller 9 and the second transfer belt 27. The first belt roller 23 is provided with a driving gear (not shown) having the same number of gear teeth as a driving gear (not shown) the photosensitive belt driving roller 21 and the first transfer roller 9. Power from a motor (not shown) is transmitted to the driving gear to rotate the first belt roller 23 clockwise.

The second belt roller 24 is located to the rear of and below the first belt roller 23. The second belt roller 24 is located facing the third transfer roller 11 through the second transfer belt 27. The second belt roller 24 follows driving rotation of the first belt roller 23, as transmitted by the second transfer belt 27, and rotates clockwise accordingly.

The third belt roller 25 is located to the rear of and above the first belt roller 23. The third belt roller 25 follows driving rotation of the second belt roller 24, as transmitted by the second transfer belt 27, and rotates clockwise accordingly.

The forth belt roller 26 is located in front of the third belt roller 25 and to the rear the first belt roller 23. The forth belt roller 26 follows driving rotation of the third belt roller 25, as transmitted by the third transfer belt 27, and rotates clockwise accordingly.

The first, second, third, and forth belt rollers 23, 24, 25, and 26 are located to form a substantially rhomboidal configuration. The second transfer belt 27 is wound around the first, second, third, and forth belt rollers 23, 24, 25, and 26. Rotation of the first belt roller 23 conveys the second transfer belt 27 around the rollers 23, 24, 25, and 26.

The second transfer belt 27 is made from a resin, such as conductive polycarbonate, or polyimide, dispersed throughout with electrically conductive particles such as carbon. The second transfer belt 27 confronts the first belt roller 23 at a position downstream with respect to the moving direction of the second transfer belt 27. Accordingly, the second transfer belt 27 moves in the same direction as the first transfer roller 23 at the nip portion where the second transfer belt 27 contacts the first transfer roller 23. The second transfer belt 27 has an entire length equal to an integral multiple of the total of the circumferential lengths of the photosensitive belt driving roller 22, the first transfer roller 9, and the first belt roller 23.

The third transfer roller 11 is located to sandwich the second transfer belt 27 between itself and the second belt roller 23 of the second transfer belt mechanism 10, in order to contact a surface of the second transfer belt 27. The third transfer roller 11 is configured to rotate in the same direction as the second transfer belt 27, that is, clockwise at the nip portion where the third transfer roller 11 contacts the second transfer belt 27. A predetermined transfer bias voltage is applied between the third transfer roller 11 and the second transfer belt 27.

The above structure allows the third transfer roller 11 to be located at the opposite side of the scanner unit 6 and the second transfer belt mechanism 10, so that toner will not enter into the scanner unit 6 in the event that toner scatters around when the color toner image is transferred.

The charging roller 12 is located upstream from the photosensitive supporting roller 20 in the moving direction of the photosensitive belt 22 in contact with a surface of the photosensitive belt 22. The charging roller 12 rotates in the same clockwise direction as the photosensitive belt 22 at a nip portion where the charging roller 12 contacts the photosensitive belt 22. A predetermined voltage is applied to the charging roller 12 to charge the surface of the photosensitive belt 22 to a uniform positive charge.

After the surface of the photosensitive belt 22 is positively charged uniformly by the charging roller 12, the surface of the photosensitive belt 22 is exposed by high speed scanning of the laser beam from the scanner unit 6 to form an electrostatic latent image based on image data.

Contact between the photosensitive belt 22 and the developing roller 15 of a certain one of the developing cartridges 7 develops the electrostatic latent image into a monochromatic visible image of the color contained in that developing cartridge 7. The monochromatic visible image is then transferred on the first transfer roller 9 when the image is brought into confrontation with the first transfer roller 9. The monochromatic visible image transferred on the first transfer roller 9 is then transferred to the second transfer belt 27 when the image is brought into confrontation with the second transfer belt 27. Thus, each monochromatic visible image transferred on the first transfer roller 9 is superimposed onto previous different-colored images on the second transfer belt 27 to form a multicolored image.

Described in more detail, first the yellow developing cartridge 7Y is moved horizontally rearward to bring the yellow developing roller 15Y into contact with the photosensitive belt 22 on which is formed an electrostatic latent image that corresponds to the yellow portion of a multi-color image. At the same time, the developing rollers 15M, 15C, and 15K of the magenta developing cartridge 7M, the cyan developing cartridge 7C, and the black developing cartridge 7K are moved horizontally forward to separate the developing rollers 15M, 15C, and 15K from the photosensitive belt 22. As a result, the electrostatic latent image that corresponds to the yellow portion of a multi-color image is developed into a yellow visible image on the photosensitive belt 22 with the toner contained in the yellow developing cartridge 7Y. Then, when movement of the photosensitive belt 22 moves the yellow visible image into confrontation with the first transfer roller 9, the yellow visible image is transferred to the second transfer belt 27.

Then, an electrostatic latent image that corresponds to the magenta portion of a multi-color image is formed on the photosensitive belt 22. At this time, the magenta developing cartridge 7M is moved horizontally to bring the developing roller 15M into contact with the photosensitive belt 22. Simultaneously, the other developing cartridges 7 are moved to separate the developing rollers 15Y, 15C, and 15K from the photosensitive belt 22. The electrostatic latent image that corresponds to the magenta portion of a multi-color image is developed into magenta visible image on the photosensitive belt 22 from the toner contained in the magenta developing cartridge 7M. The magenta visible image is then transferred onto the first transfer roller 9. After that, when the magenta visible image faces the second transfer belt 27, the magenta visible image on the first transfer roller 9 is transferred onto the second transfer belt 27, which supports the yellow toner image thereon, so that the magenta visible image overlaps the yellow toner image.

The operation described above is similarly repeated for the cyan and black toners contained in the cyan and black developing cartridges 7C and 7K, respectively. Therefore, a multicolor image is formed on the second transfer belt 27.

The multicolor image formed on the second transfer belt 27 as described above is transferred on a sheet 3 in a single transfer action, as the sheet 3 passes between the second transfer belt 27 and the third transfer roller 11.

The laser printer 1 further includes a charge removing lamp 42 for removing charge from the surface of the photosensitive belt 22 after image transfer. The charge removing lamp 42 faces the photosensitive belt 22 at a position on the opposite side of the photosensitive belt 22 from the developing cartridges 7. The charge removing lamp 42 is located downstream from the first transfer roller 9 in the moving direction of the photosensitive belt 22. The charge removing lamp 42 is located upstream with respect to the charging roller 12. Accordingly, the charge on the surface of the photosensitive belt 22 is removed by the charge removing lamp 42, every time a visible image is transferred to the first transfer belt 9.

The fixing unit 13 is located to the rear of the second transfer belt 27 and at the opposite side of the photosensitive belt mechanism 8 from the developing cartridges 7. The fixing unit 13 includes a heating roller 28, and a pressing roller 29 for pressing the heating roller 28. The heating roller 28 has a metallic halogen lamp for heating. The heating roller 28 thermally fixes the multicolor image onto the sheet while the sheet 3 is passing between the heating roller 28 and the pressing roller 29. The sheet 3 on which the multicolor image is thermally fixed is discharged through a discharge opening in the housing 2 forward onto a sheet-ejecting tray 30 formed on an upper part of the housing 2. Because the discharge opening in the housing 2 is adapted to discharge sheets 3 forward toward the front of the housing 2, the user can quickly and easily view the images printed on the sheets 3.

The color laser printer 1 further includes a belt cleaner 31 for recovering toner remaining on the photosensitive belt 22. The belt cleaner 31 is located over the first belt roller 23 of the second transfer belt 27 at the opposite side of the photosensitive belt 22 from the developing cartridges 7. The belt cleaner 31 includes a belt cleaning roller 32, a recovering roller 33, and a removing blade 34 in a cleaning box 35. The belt cleaner 31 further includes a recovering box 37, which is connected with the cleaning box 35 through a connecting tube 36.

The cleaning box 35 is located downstream from the first transfer roller 9 in the moving direction of the photosensitive belt 22. The cleaning box 35 is located at the opposite side of the photosensitive belt mechanism 8 from the developing cartridges 7. The cleaning box 35 has an opening on the surface thereof facing the photosensitive belt 22. The belt cleaning roller 32 is supported rotatably in the opening. The belt cleaning roller 32 is located in contact with the photosensitive belt 22. The belt cleaning roller 32 is applied with a predetermined cleaning bias voltage with respect to the photosensitive belt 22. The recovering roller 33 rotates in contact with the belt cleaning roller 32 from the side opposite the photosensitive belt 22. The belt cleaning roller 32 is applied with a predetermined bias voltage. The removing blade 34 is configured to contact the recovering roller 33 from below.

The recovering box 37 is located inside the loop of the photosensitive belt 22 wound around the photosensitive belt supporting roller 20 and the photosensitive belt driving roller 21. The recovering box 37 is connected with the cleaning box 35 through the connecting tube 36 positioned at the side of photosensitive belt 22.

The toner remaining on the photosensitive belt 22 after the image is transferred to the first transfer roller 9 is electrically captured by the belt cleaning roller 32, when the movement of the photosensitive belt 22 moves the remaining toner into confrontation with the belt cleaning roller 32. When the remaining toner contacts the recovering roller 33, the remaining toner captured onto the belt cleaning roller 32 is then electrically recovered by the recovering roller 33. The remaining toner recovered on the recovering roller 33 is removed by the removing blade 34, and then recovered to the recovering box 37 through the connecting tube 36.

As described above, the recovering box 37 is located inside of the photosensitive belt 22 wound around the photosensitive belt supporting roller 20 and the photosensitive belt driving roller 21. This leads to effective use of the inner space defined by the photosensitive belt 22 so that the printer can be made more compact.

The color laser printer 1 further includes a transfer cleaner 38 for recovering toner on the third transfer roller 11. The transfer cleaner 38 is located at the side of the third transfer roller 11, and includes a transfer cleaning roller 39 and a removing blade 40 provided in a cleaning box 41. The cleaning box 41 is located to face the third transfer roller 11 downstream from the second transfer belt 27 in the moving direction of the third transfer roller 11. The cleaning box 41 has an opening facing the third transfer roller 11. The transfer cleaning roller 39 is supported rotatably at the opening of the cleaning box 41 in contact with the third transfer roller 11. The transfer cleaning roller 39 is applied with a predetermined bias voltage with respect to the third transfer roller 11. The removing blade 40 contacts the transfer cleaning roller 39 from the side opposite from the third transfer roller 11.

Any toner clinging to the third transfer roller 11 is electrically captured by the transfer cleaning roller 39 when rotation of the third transfer roller 11 moves the toner into confrontation with the transfer cleaning roller 39. The remaining toner captured on the transfer cleaning roller 39 is removed by the removing blade 34 and collected in the cleaning box 41.

The developing rollers 15 rotate and the photosensitive belt 22 moves downward at the nip portion where the developing rollers 15 contact the photosensitive belt 22. Then, each color image is transferred from the photosensitive belt 22 to the first transfer roller 9 and then from the first transfer roller 9 to the second transfer belt 27. In other words, each image is transferred twice. After that, each image is transferred to a sheet 3 by the third transfer roller 11. Accordingly, four developing cartridges 7 and the fixing unit 13 are located on opposite sides of the photosensitive belt mechanism 8.

The developing rollers 15 and the photosensitive belt 22 can be rotated and moved, respectively, in the same direction at their nip portions. In addition, the photosensitive belt 22 and the first transfer roller 9, the first transfer roller 9 and the second transfer belt 27, and the second transfer belt 27 and the third transfer roller 11 can be rotated and moved in the same direction at their respective nip portions. As a result, the four developing cartridges 7 and the fixing unit 13 need not be located at the same side of the photosensitive belt mechanism 8 stacked on top of each other. As a result, the printer can be made more compact using a simple configuration.

Each single-color visible image carried on the photosensitive belt 22 is transferred to the first transfer roller 9 and then onto the second transfer belt 27. Single-color images transferred subsequently from the first transfer roller 9 to the second transfer belt 27 are superimposed onto previously transferred single-colored images to form a multicolor image. That is, each single-color visible image is transferred from the first transfer roller 9 onto the second transfer belt 27 without being superimposed by another image on the first transfer roller 9. Therefore, each single-color visible image on the photosensitive belt 22 is temporarily transferred to the first transfer roller 9 as a single color image. Accordingly, large difference in electric potential will not develop between unexposed portions of the photosensitive belt 22 and the second transfer belt 27 through toner so that undesirable increases in the charge-to-mass ratio of toner that forms the visible image can be effectively suppressed. Similarly, undesirable increases in the charge-to-mass ratio of toner that forms subsequently superimposing visible images can also be suppressed. Therefore, multicolor images with good quality can be formed.

The first transfer is performed by the first transfer roller 9 provided between the photosensitive belt 22 and the second transfer belt 27. Therefore, power for the first transfer can be transmitted using a gear. The first transfer roller 9 can be precisely rotated so that transfer accuracy is improved. An image having good quality can be formed.

The photosensitive belt mechanism 8 is used instead of a photosensitive drum. The printer 1 can be made more compact because a photosensitive belt is smaller than a photosensitive drum.

The second transfer is performed by the second transfer belt mechanism 10 provided between the first transfer roller 9 and the third transfer roller 11. Therefore, the printer 1 can be made more compact because a transfer belt is smaller than a roller.

The photosensitive belt driving roller 21, the first transfer roller 9, and the first belt roller 23 all have substantially the same diameter. Therefore, by rotating these rollers 21, 9, 23 at a constant speed, any phase shift caused by eccentric rotation of the rollers 21, 9, 23 can be adjusted. Therefore, the single-color visible images can be transferred to and superimposed on the same position precisely.

In addition, the driving gear of the photosensitive belt driving roller 21, the driving gear of the first transfer roller 9, and the driving gear of the first belt roller 23 have substantially the same number of gear teeth. Therefore, the photosensitive driving roller 21, the first transfer roller 9, and the first belt roller 23 can be rotated at a constant speed easily and precisely. Therefore, each single-color visible image can be transferred and superimposed at the same position precisely.

It should be noted that the driving gear of the photosensitive belt driving roller 21, the driving gear of the first transfer roller 9, and the driving gear of the first belt roller 23 may be coupled to a single motor through a gear train, so that they are linked with each other.

As described above, the first transfer roller 9 is located so as to not contact a part of the photosensitive belt 22 that contacts the photosensitive belt driving roller 21, which is located in confrontation with first transfer roller 9. The first transfer roller 9 is also located so as to not contact a part of the second transfer belt 27 that contacts the first belt roller 23, which is located in confrontation with the first transfer roller 9. Accordingly, the first transfer roller 9 and the photosensitive belt driving roller 21 are located at positions shifted from each other through the photosensitive belt 22. The first transfer roller 9 and the first belt roller 23 are located at positions shifted from each other through the second transfer belt 27. In other words, the photosensitive belt driving roller 21, the first transfer roller 9, and the first belt roller 23 are located at positions all shifted from each other. Therefore, pressure from other rollers is not applied at the nip portions between belts and rollers, so that good transfer is ensured.

The second transfer belt 27 has a length equal to an integral multiple of the total peripheral of the photosensitive belt driving roller 21, the first transfer roller 9, and the first belt roller 23. Any phase shift between the photosensitive belt driving roller 21, the first transfer roller 9, and the first belt roller 23 can be adjusted, so that each single-color visible image can be transferred and overlapped at the same position precisely. Accordingly, a multicolor image with better quality can be formed.

A link member (not shown) is provided for selectively connecting the photosensitive belt mechanism 8 and the first transfer roller 9 to each other. When the photosensitive belt mechanism 8 and the first transfer roller 9 are coupled to each other by the link member, they can be mounted into and removed from the housing 2 as an integral unit. Therefore, maintenance can be effectively performed using simple operations.

A link member (not shown) is provided for selectively connecting the first transfer roller 9 and the second transfer belt mechanism 10 to each other. When the first transfer roller 9 and the second transfer belt mechanism 10 are coupled to each other by the link member, they can be mounted into and removed from the housing 2 as an integral unit. Therefore, maintenance can be effectively performed using simple operations.

The color laser printer 1 may further include a transfer roller 44 positioned under the photosensitive driving roller 21 as indicated by two-dot chain line in FIG. 1. The transfer roller 44 is located to face the photosensitive belt driving roller 21 through the transfer belt 22. The transfer roller 44 is configured to transfer a single-color visible image carried on the photosensitive belt 22 to a sheet 3 directly. If such a transfer roller 44 is provided, a monochrome image can be formed readily at a high speed by forming a black visible image on the photosensitive belt 22 by means of the developing roller 15 of the black developing cartridge 7K and transferring the formed black visible image onto a sheet 3 directly.

Each of vertically-stacked developing cartridges is inclined with respect to a horizontal so that the front end of each cartridge is higher than the rear end. This forms a space between the front end of the black developing cartridge and the sheet-supply tray 45. The sheet-supply roller 46 is located in the predetermined space. This configuration effectively uses the space around the front side of each of the inclined developing cartridges 7. Therefore, the printer can be made compact.

Next, a color laser printer 151 according to a second embodiment of the present invention will be described with reference to FIG. 2. In the description of the color laser printer 151, components that have corresponding components in the printer 1 will be referred to using reference numbers of the corresponding components added with 100.

As in the first embodiment, a fixing unit 113 and four developing cartridges 107 are disposed on opposite sides of a photosensitive belt mechanism 108. However, according to the second embodiment, developing rollers 115 and a photosensitive belt 122 move in the opposite direction at the nip portion. That is, the developing rollers 115 rotate downward at the nip portion and the photosensitive belt 122 moves upward at the nip portion, rather than both the photosensitive belt and the developing rollers moving downward at the nip portion. Also, a single intermediate transfer belt 153 is provided, rather than the first transfer roller 9 and the second transfer belt mechanism 10.

A sheet feed portion 104 of the color laser printer 151 is disposed with the opposite orientation of the sheet feet portion 4 of the first embodiment. Also, registration rollers 152 are disposed above a sheet-feed roller 146. The sheet-feed roller 146 feeds out uppermost sheets 3 in a sheet feet tray 145 one at a time toward the rear of a housing 102. After the registration rollers 52 perform a predetermined registration operation, the sheets are transported to image forming portion 105.

The image forming portion 105 includes a scanner unit 106, four developing cartridges 107, a photosensitive belt mechanism 8, a charge roller 12, a fixing portion 13, the intermediate transfer belt mechanism 153, and the transfer roller 154.

The scanner unit 106 is located in the housing 102 at a position over the sheet-supply portion 104 and below the intermediate transfer belt mechanism 153. In other words, relative vertical positions of the scanner unit 106 and the intermediate transfer belt mechanism 153 are inverted compared to the scanner unit 6 and the second transfer belt mechanism 10 of the first embodiment. The scanner unit 106 includes a laser beam emitter (not shown), a polygon mirror 114 driven to rotate, a lens 149, and a reflecting mirror 150*a* in a scanner housing 147. The scanner unit 106 further includes a reflecting mirror 150*b* disposed below an opening 148. When the scanner unit 106 operates, the laser beam emitter emits a laser beam based on image data. As indicated by the arrow in FIG. 2, the laser beam reflects off the polygon mirror 114, passes through the lens 149, reflects off the reflecting mirror 150*a* to exit the scanner housing 147 through the hole 148. The laser beam further reflects off the reflecting mirror 150*b* to impinge on a surface of the photosensitive belt 122.

The four developing cartridges 107 and the photosensitive belt mechanism 108 have the same configuration as the developing cartridges 7 and the photosensitive belt mechanism 8 of the first embodiment. However, the four developing cartridges 107 are stacked in the opposite order from the developing cartridges 7. That is, as shown in FIG. 2, the yellow developing cartridge 7Y is positioned on the bottom of the stack, followed by the magenta developing cartridge 7M and the cyan developing cartridge 7C in this order, and the black developing cartridge 7K positioned on the top of the stack. Also, the photosensitive belt 122 circulates between the photosensitive belt support roller 120 and a photosensitive belt drive roller 121 in the opposite direction from the photosensitive belt 22 of the first embodiment. That is, the photosensitive belt 122 circulates in the counterclockwise direction as viewed in FIG. 2. For this reason, the photosensitive belt 122 moves from the developing roller 115 of the yellow developing cartridge 107Y, which is in the lowermost position, to the developing roller 115 of the black developing cartridge 107K, which is in the uppermost position. The photosensitive belt 122 moves in the opposite direction of the developing rollers 115 at the nip portion, that is, the developing rollers 115 move downward and the photosensitive belt 122 moves upward at the nip portion.

The intermediate transfer belt mechanism 153 is positioned above the scanner unit 106 and to the rear of the photosensitive belt mechanism 108. That is, the intermediate transfer belt mechanism 153 is located on the opposite side of the photosensitive belt mechanism 108 than the four developing cartridges 107. The intermediate transfer belt mechanism 153 includes an intermediate transfer belt 158, an intermediate transfer belt drive roller 155, a first intermediate transfer support roller 156, and a second intermediate transfer support roller 157. The intermediate belt 158 is an endless belt wrapped around the three rollers 155, 156, and 157.

The intermediate transfer belt drive roller 155 is positioned in confrontation with the photosensitive belt drive roller 121, with the photosensitive belt 122 and the intermediate transfer belt 158 sandwiched therebetween. The first intermediate transfer support roller 156 is positioned diagonally below and to the rear of the intermediate transfer belt drive roller 155. The first intermediate transfer support roller 156 is disposed in confrontation with a transfer roller 154 to be described later, with the intermediate transfer belt 158 sandwiched therebetween. The second intermediate transfer support roller 157 is disposed to the front of the first intermediate transfer support roller 156 and below the intermediate transfer belt drive roller 155.

The rollers 155, 156, 157 are disposed to define an imaginary triangle. The intermediate transfer belt 158 is wrapped around the rollers 155, 156, 157. Drive force of the intermediate transfer belt drive roller 155 conveys the intermediate transfer belt 158 in a circulating manner around the outer periphery of the rollers 155, 156, 157, following the clockwise direction. By this, the intermediate transfer belt 158 moves in the same direction as the photosensitive belt 122 at the nip portion between the intermediate transfer belt 158 and the photosensitive belt 122, near the intermediate transfer belt drive roller 155.

The transfer roller 154 is disposed so as to contact the surface of the intermediate transfer belt 158 at a position in confrontation with the first intermediate transfer belt roller 156, with the intermediate transfer belt 158 sandwiched between the transfer roller 154 and the intermediate transfer belt 158. The transfer roller 154 rotates counterclockwise so as to move in the same direction as the intermediate transfer belt 158 at the nip portion between the transfer roller 154 and the intermediate transfer belt 158. A predetermined transfer bias is applied between the transfer roller 154 and the intermediate transfer belt 158.

A charge roller 112 is provided with the same configuration as the charge roller 12 of the first embodiment. The charge roller 112 is positioned near to and upstream from the photosensitive belt support roller 120 with respect to the movement direction of the photosensitive belt 122 so as to contact the surface of the photosensitive belt 122. The charge roller 112 rotates clockwise and moves in the same direction as the photosensitive belt 122 at the nip portion between itself and the photosensitive belt 122.

After the surface of the photosensitive belt 122 is positively charged uniformly by the charging roller 112, the surface of the photosensitive belt 122 is exposed by high speed scanning of the laser beam from the scanner unit 106 to form an electrostatic latent image based on image data.

Contact between the photosensitive belt 122 and the developing roller 115 of one of the certain developing cartridge 107 develops the electrostatic latent image into a monochromatic visible image of the color contained in that developing cartridge 107. The monochromatic visible image is then transferred on the intermediate transfer belt 158 when the monochromatic visible image is brought into confrontation with the intermediate transfer belt 158. The monochromatic visible images in the different colors are transferred one on top of the other on the intermediate transfer belt 158 to form a multicolored image.

First a yellow visible image is formed on the photosensitive belt 122 with the toner contained in the yellow developing cartridge 107Y, which is in the lowermost position of the developing cartridge stack. Then, when movement of the photosensitive belt 122 moves the yellow visible image into confrontation with the first transfer roller 109, the yellow visible image is transferred to the second transfer belt 127. Then, an electrostatic latent image is again formed on the photosensitive belt 122 and developed into a magenta visible image on the photosensitive belt 122 from the toner contained in the magenta developing cartridge 107M, which is the second from the lowest developing cartridge in the stack. When the magenta visible image is moved into confrontation with the intermediate transfer belt 158, the magenta visible image is transferred onto the intermediate transfer belt 158 in an overlapping manner onto the yellow visible image.

The operations described above are repeated for the cyan and black toners contained in the cyan and black developing cartridges 107C and 107K, respectively. Therefore, a multicolor image is formed on the intermediate transfer belt 158.

The multicolor image formed on the intermediate transfer belt 158 is transferred on a sheet 3 in a single transfer action, as the sheet 3 passes between the intermediate transfer belt 158 and the transfer roller 154.

The laser printer 151 further includes a belt cleaner 131 and a charge removing lamp 142 with the same configuration as the belt cleaner 131 and the charge removing lamp 142 of the first embodiment. The belt cleaner 131 is located over the charging roller 112 at the opposite side of the photosensitive belt 122 from the developing cartridges 107. The charge removing lamp 142 is disposed in confrontation with the photosensitive belt 122 at a position downstream from the intermediate transfer belt 158, and upstream from the belt cleaner unit 131, with respect to the movement direction of the photosensitive belt 122.

A transfer cleaner 138 is provided with the same configuration as the transfer cleaner 38 of the first embodiment. The transfer cleaner 138 is located below the transfer roller 154 so that a transfer cleaning roller 139 thereof contacts the transfer roller 154 from below.

A fixing unit 113 is provided with the same configuration as the fixing unit 13 of the first embodiment. The fixing unit 113 is disposed above the transfer roller 154 on the opposite side of the photosensitive belt mechanism 108 than the developing cartridges 107. Sheets 3 that have a multi-color image thermally fixed thereon by the fixing unit 113 are discharged onto a discharge tray 130 formed at the upper portion of the housing 103.

As described above, the developing rollers 115 and the photosensitive belt 122 move in the opposite directions at nip portions where the developing rollers 115 contact the photosensitive belt 122. That is, the developing rollers 15 move downward and the photosensitive belt 122 moves upward at the nip portions. With this configuration, the developing cartridges 107 and the fixing unit 113 can be disposed on both sides of the photosensitive belt 122, without stacking the plurality of developing rollers 115 above the fixing portion 113 and without performing two intermediate transfers in the manner of the color laser printer 1 of FIG. 1. The configuration of the printer 151 is simple and compact.

The photosensitive belt mechanism 108 is configured as an integral unit that can be detachably removed from the opening in the top of the housing 102. Also, the intermediate transfer belt mechanism 153 can be separated from the photosensitive belt mechanism 108 while the photosensitive belt mechanism 108 is being removed, by pivoting the intermediate transfer belt mechanism 153 rearward around the first transfer belt support roller 156 as indicated by arrow 159 of FIG. 2.

With this configuration, the photosensitive belt mechanism 108 is exchanged in the following manner. First, intermediate transfer belt mechanism 153 is moved rearward away from the photosensitive belt mechanism 108. Then the photosensitive belt mechanism 108 is pulled out from the housing 102 through the top of the housing 102. Next, a new photosensitive belt mechanism 108 is mounted into the housing 102 through the top of the housing 102. Then, the intermediate transfer belt mechanism 153 is moved forward back into contact with the photosensitive belt mechanism 108. By these simple operations, the photosensitive belt mechanism 108 can be easily exchanged. Maintenance can be efficiently performed. It should be noted that in the color laser printer 1 of FIG. 1, the photosensitive belt mechanism 8 can also be configured as an integral unit and one or both of the first and second transfer rollers 9, 10 can be configured separable from the photosensitive belt mechanism 8, so that the photosensitive belt mechanism 108 can be detachably removed from the opening in the top of the housing 2.

Next, a color LED printer 261 according to a third embodiment of the present invention will be described with reference to FIG. 3. In the description of the color LED printer 261, components that have corresponding components in the printer 151 will be referred to using reference numbers of the corresponding components added with 100.

As in the second embodiment, a fixing unit 213 and four developing cartridges 207 are disposed on opposite sides of a photosensitive belt mechanism 208. However, according to the third embodiment, the developing rollers 215 and a photosensitive belt 222 move upward at the nip portions where the developing rollers 215 contact the photosensitive belt 222, rather than moving in opposite directions like the developing rollers 115 and the photosensitive belt 122 of the second embodiment.

The color LED printer 261 includes a sheet supply portion 204 with the same configuration as the sheet supply portion 104 of the second embodiment. The sheet supply portion 204 uses a sheet-supply roller 46 to feed each sheet at the top of the stacked sheets out to the image-forming unit 205.

An image-forming unit 205 of the third embodiment includes four developing cartridges 207, a photosensitive belt mechanism 208, an intermediate transfer belt mechanism 253, a transfer roller 253, a charging roller 212, and a fixing unit 213. However, the image-forming unit 205 includes an LED array 262 instead of the scanner unit 106.

The LED array 262 is located on the opposite side of the photosensitive belt 222 than the developing cartridges 207 at a location in confrontation with the photosensitive belt support roller 220, in order to emit light based on image data, and accordingly expose the surface of the photosensitive belt 222 that contacts the photosensitive belt support roller 220.

The four developing cartridges 207 have the same configuration and positioning as the four developing cartridges 107 of the second embodiment. That is, the yellow developing cartridge 207Y is in the lowermost position of the developing cartridge stack. Then comes the magenta developing cartridge 207M and the cyan developing cartridge 207C in this order. The black developing cartridge 207K is disposed in the upper position of the developing cartridge stack. It should be noted that this vertical order can be reversed.

The sheet-supply roller 217 and the developing rollers 215 of the developing cartridge 207 are provided rotatable while in a slightly compressed condition. The developing rollers 215 rotate in the clockwise direction to move upward at the nip portion where the developing rollers 215 contact the photosensitive belt 222. Layer-thickness regulating blades 216 are positioned so as to press against the surface of each developing roller 215 from below.

Figure 2:
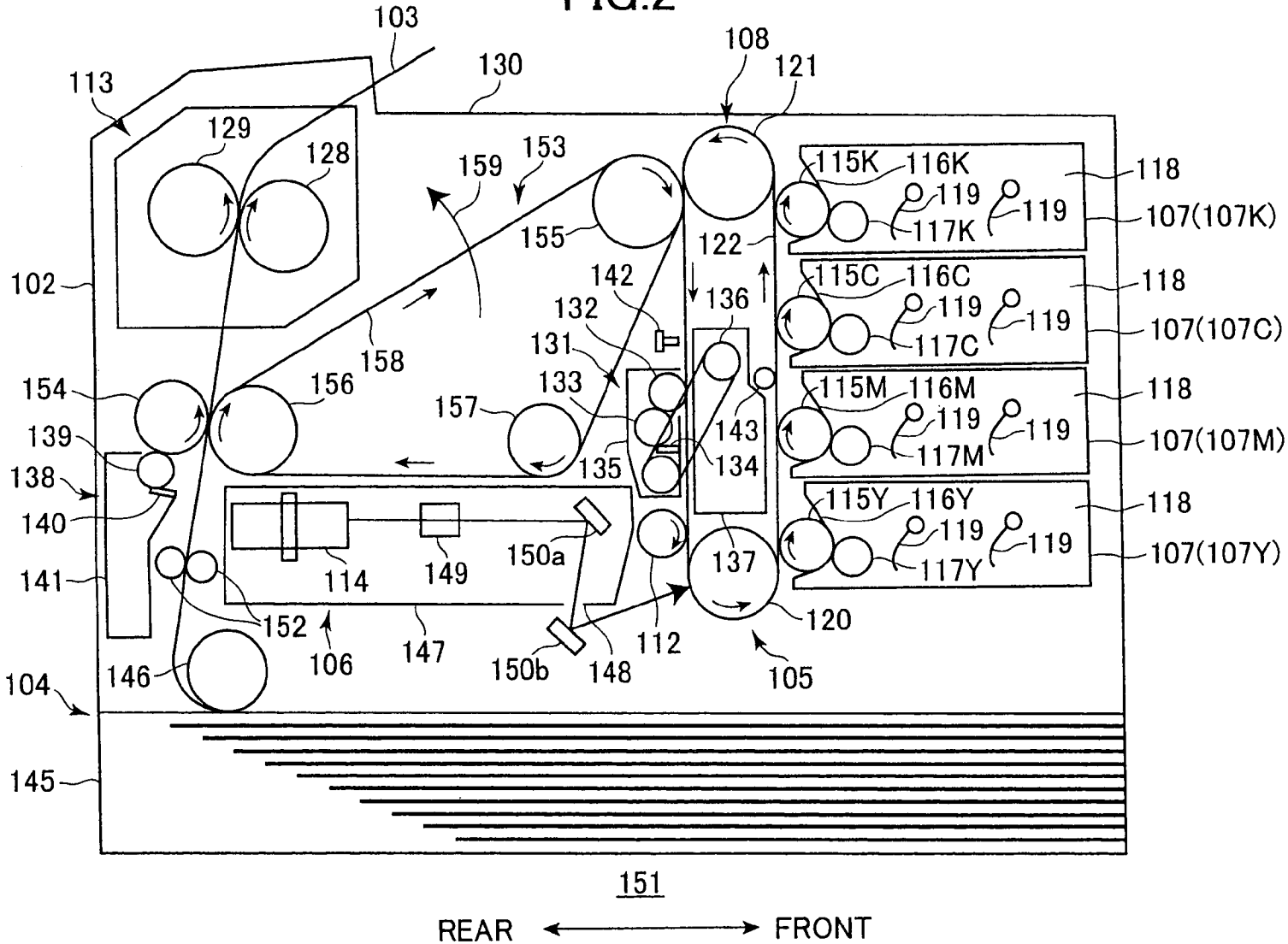
FIG. 2 is a cross-sectional view showing a color laser printer according to a second embodiment of the present invention.

The photosensitive belt mechanism 208 has the same configuration as the photosensitive belt mechanism 108 of FIG. 2, and includes a photosensitive belt 222 that circulates in the counterclockwise direction between a photosensitive belt support roller 220 and a photosensitive belt drive roller 221.

The photosensitive belt 222 moves from the developing roller 215 of the yellow developing cartridge 207Y, which is in the lowermost position, to the developing roller 215 of the black developing cartridge 207K, which is in the uppermost position. The photosensitive belt 222 moves in the same direction as the developing rollers 215 at the nip portion, that is, the developing rollers 215 and the photosensitive belt 222 move upward at the nip portion.

The intermediate transfer belt mechanism 253 is disposed to the rear of the photosensitive belt mechanism 208, that is, on the opposite side of the photosensitive belt mechanism 208 than the developing cartridges 207. The intermediate transfer belt mechanism 253 has the same configuration as the intermediate transfer belt mechanism 153 of the second embodiment, and includes an intermediate transfer belt drive roller 255, a first intermediate transfer belt support roller 256, a second intermediate transfer belt support roller 257, and an intermediate transfer belt 258. The intermediate transfer belt 258 is wrapped around the three rollers 255, 256, 257.

The intermediate transfer belt drive roller 255 is positioned in confrontation with the photosensitive belt drive roller 221, with the photosensitive belt 222 and the intermediate transfer belt 258 sandwiched therebetween. The first intermediate transfer support roller 256 is positioned diagonally below and to the rear of the intermediate transfer belt drive roller 255. The first intermediate transfer support roller 256 is disposed in confrontation with a transfer roller 254, with the intermediate transfer belt 258 sandwiched therebetween. The second intermediate transfer support roller 257 is disposed to the rear of the first intermediate transfer support roller 256 and below the intermediate transfer belt drive roller 255.

The rollers 255, 256, 257 are disposed to define an imaginary triangle. The intermediate transfer belt 258 is wrapped around the rollers 255, 256, 257. Drive force of the intermediate transfer belt drive roller 255 conveys the intermediate transfer belt 258 in a circulating manner around the outer periphery of the rollers 255, 256, 257, following the clockwise direction. By this, the intermediate transfer belt 258 moves in the same direction as the photosensitive belt 222 at the nip portion between the intermediate transfer belt 258 and the photosensitive belt 222, near the intermediate transfer belt drive roller 255.

The transfer roller 254 is disposed so as to contact the surface of the intermediate transfer belt 258 at a position below and in confrontation with the first intermediate transfer belt roller 256, with the intermediate transfer belt 258 sandwiched between the transfer roller 254 and the intermediate transfer belt 258. The transfer roller 254 rotates counterclockwise so as to move in the same direction as the intermediate transfer belt 258 at the nip portion between the transfer roller 254 and the intermediate transfer belt 258. A predetermined transfer bias is applied between the transfer roller 254 and the intermediate transfer belt 258.

A charge roller 212 is provided with the same configuration as the charge roller 112 of the second embodiment. The charge roller 212 is positioned near to and upstream from the photosensitive belt support roller 220 with respect to the movement direction of the photosensitive belt 222 so as to contact the surface of the photosensitive belt 222. The charge roller 212 rotates clockwise and moves in the same direction as the photosensitive belt 222 at the nip portion between itself and the photosensitive belt 222.

After the surface of the photosensitive belt 222 is positively charged uniformly by the charging roller 212, the surface of the photosensitive belt 222 is exposed by the LED array 262 to form an electrostatic latent image based on image data. Contact between the photosensitive belt 222 and the developing roller 215 of one of the certain developing cartridge 207 develops the electrostatic latent image into a monochromatic visible image of the color contained in that developing cartridge 207. The monochromatic visible image is then transferred on the intermediate transfer belt 258 when the monochromatic visible image is brought into confrontation with the intermediate transfer belt 258. The monochromatic visible images in the different colors are transferred one on top of the other on the intermediate transfer belt 258 to form a multicolored image.

In other words, first a yellow visible image is formed on the photosensitive belt 222 with the toner contained in the yellow developing cartridge 207Y, which is in the lowermost position of the developing cartridge stack. Then, when movement of the photosensitive belt 222 moves the yellow visible image into confrontation with the first transfer roller 209, the yellow visible image is transferred to the second transfer belt 227. Then, an electrostatic latent image is again formed on the photosensitive belt 222 and a magenta visible image is formed on the photosensitive belt 222 from the toner contained in the magenta developing cartridge 207M, which is the second from the lowest developing cartridge in the stack. When the magenta visible image is moved into confrontation with the intermediate transfer roller 258, the magenta visible image is transferred onto the intermediate transfer roller 258 in an overlapping manner onto the yellow visible image.

The operations described above are repeated for the cyan and black toners contained in the cyan and black developing cartridges 207C and 207K, respectively. Therefore, a multicolor image is formed on the intermediate transfer belt 258.

The multicolor image formed on the intermediate transfer belt 258 is transferred on a sheet 3 in a single transfer action, as the sheet 3 passes between the intermediate transfer belt 258 and the transfer roller 254.

The laser printer 151 further includes a belt cleaner 231 and a charge removing lamp 242 with the same configuration as the belt cleaner 131 and the charge removing lamp 142 of the second embodiment. The belt cleaner 231 is located over the charging roller 212 at the opposite side of the photosensitive belt 222 from the developing cartridges 207. The charge removing lamp 242 is disposed in confrontation with the photosensitive belt 222 at a position downstream from the intermediate transfer belt 258, and upstream from the belt cleaner unit 231, with respect to the movement direction of the photosensitive belt 222.

A fixing unit 213 is provided with the same configuration as the fixing unit 113 of the second embodiment. The fixing unit 213 is disposed to the rear of the transfer roller 254 on the opposite side of the photosensitive belt mechanism 208 than the developing cartridges 207. Sheets 3 that have a multi-color image thermally fixed thereon by the fixing unit 213 are discharged onto a discharge tray 230 formed at the upper portion of the housing 203.

As described above, the developing cartridges 207 are arranged in the opposite vertical order than the developing cartridges 7 of the first embodiment, and the developing rollers 215 and the photosensitive belt 222 move in the same direction at nip portions where the developing rollers 215 contact the photosensitive belt 222. With this configuration, the developing cartridges 207 and the fixing unit 213 can be disposed on both sides of the photosensitive belt 222, without stacking the plurality of developing rollers 215 above the fixing portion 213 and without performing two intermediate transfers in the manner of the color laser printer 1 of FIG. 1. The configuration of the printer 261 is simple and compact.

It should be noted that a motor 263 is provided as the drive source of the photosensitive belt drive motor 221. The motor 263 is disposed within the loop shape of the photosensitive belt 222 of the photosensitive belt mechanism 208 at a position near the photosensitive belt drive roller 221. The motor 263 drives rotation of the photosensitive belt drive roller 221 through a gear 264, in order to move the photosensitive belt 222. Because the motor 263 is located within the loop of the photosensitive belt 222, the space within the loop of the photosensitive belt 222 can be effectively utilized, and the printer 261 can be made more compact.

Because the LED array 262 is located between the photosensitive belt support roller 220 and the first intermediate transfer belt support roller 256, the space between the photosensitive belt mechanism 208 and the intermediate transfer belt mechanism 253 can be effectively utilized and the printer 261 can be made more compact.

Next, a color LED printer 371 according to a fourth embodiment of the present invention will be described with reference to FIG. 4. In the description of the color LED printer 371, components that have corresponding components in the printer 261 will be referred to using reference numbers of the corresponding components added with 100.

Figure 4:
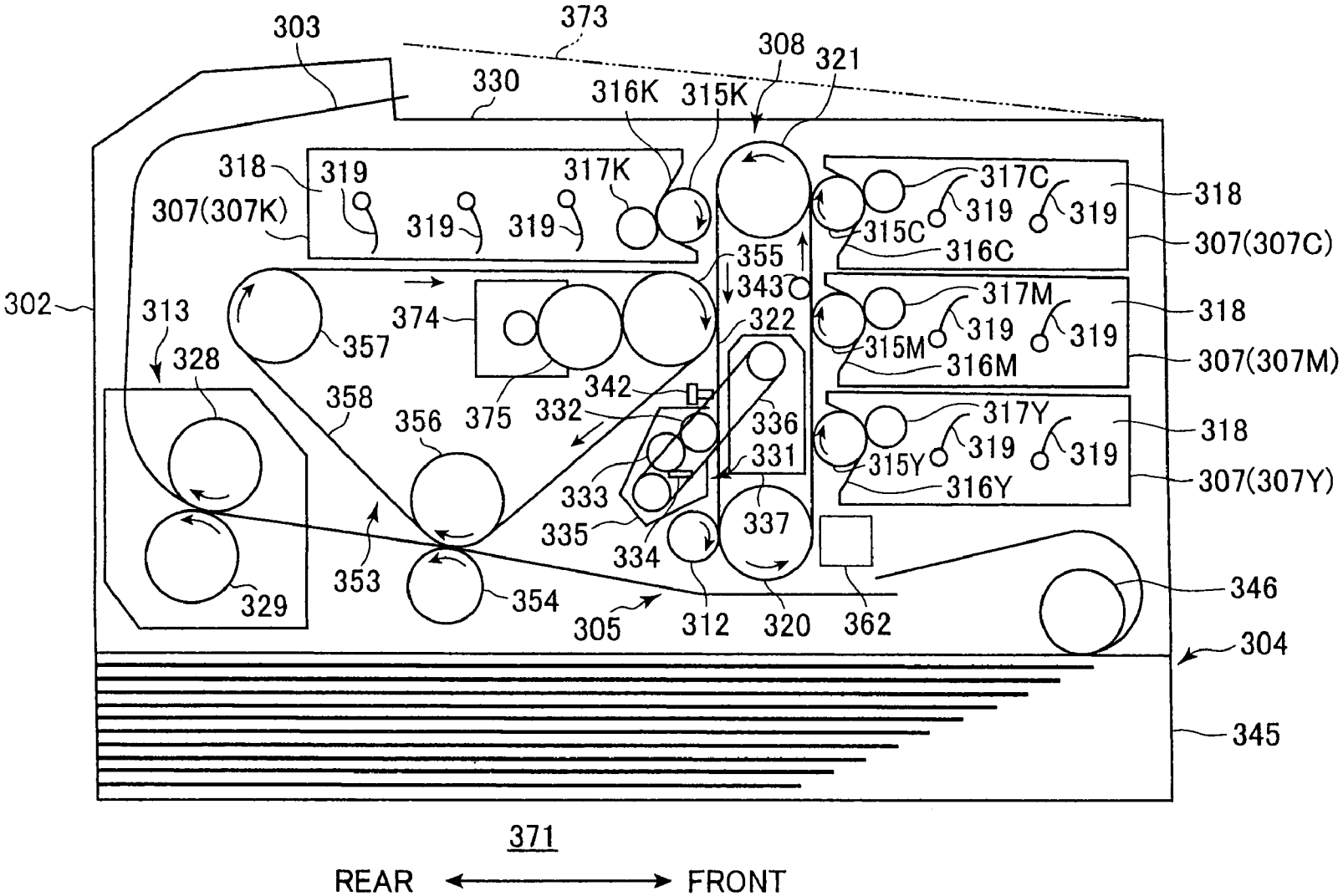
FIG. 4 is a cross-sectional view showing a color LED printer according to a fourth embodiment of the present invention.

As shown in FIG. 4, the color LED printer 371 includes developing cartridges 307 disposed on both sides of the photosensitive belt mechanism 308. That is, the black developing cartridge 307K is disposed to the rear of the photosensitive belt mechanism 308 and the other developing cartridges 307C, 307M, and 307Y are disposed to the front of the photosensitive belt mechanism 308. Both the photosensitive belt 322 and the developing roller 315 of the black developing cartridge 307K move downward at the nip portion between the photosensitive belt 322 and the developing roller 315 of the black developing cartridge 307K. The photosensitive belt 322 and the developing rollers 315 of the other developing cartridges 307C, 307M, and 307Y move upward at the nip portion between photosensitive belt 322 and the developing rollers 315 of the other developing cartridges 307C, 307M, and 307Y. This configuration enables the printer 371 to be made more compact.

The LED array 362 is located on the same side of the photosensitive belt 322 as the other developing cartridges 307C, 307M, and 307Y at a location in confrontation with the photosensitive belt support roller 320, in order to emit light based on image data, and accordingly expose the surface of the photosensitive belt 322 that contacts the photosensitive belt support roller 320.

Of the four developing cartridges 307, the black developing cartridge 307K has substantially the same configuration as the black developing cartridge 107K of the color laser printer 151 of FIG. 2 and is disposed on the same side of the photosensitive belt mechanism 308 as the fixing unit 313. The other developing cartridges 307C, 307M, and 307Y have substantially the same configuration as the developing cartridges 207C, 207M, and 207Y of the color LED printer 261 and are disposed on the opposite side of the photosensitive belt mechanism 308 than the fixing unit 313.

The black developing cartridge 307K is disposed above the intermediate transfer belt mechanism 353 in substantially parallel alignment with the upper surface of the intermediate transfer belt 358 of the intermediate transfer belt mechanism 353. The developing roller 315 of the black developing cartridge 307K rotates clockwise downward at the nip portion between the developing roller 315 and the photosensitive belt 322.

It should be noted that the black developing cartridge 307K has a larger toner container 318 than the toner containers 318 of the other developing cartridges 307C, 307M, and 307Y, because black toner is consumed in greater quantities during image formation than the other colors of toner. Because the black developing cartridge 307K is disposed on a different side of the photosensitive belt mechanism 308 than the other developing cartridges 307C, 307M, and 307Y and also has a larger toner container 318, the black developing cartridge 307K will need to be exchanged less frequently and maintenance is facilitated.

With respect to the other developing cartridges 307C, 307M, and 307Y, the yellow developing cartridge 307Y is in the lowermost position of the developing cartridge stack. Then comes the magenta developing cartridge 307M and the cyan developing cartridge 307C in this order, with the cyan developing cartridge 307C disposed in the upper position of the developing cartridge stack. In the same manner as the color LED printer 261 shown in FIG. 3, the developing rollers 315 rotate in the clockwise direction to move upward at the nip portion where the developing rollers 315 contact the photosensitive belt 322. Layer-thickness regulating blades 316 are positioned so as to press against the surface of each developing roller 315 from below.

Figure 3:
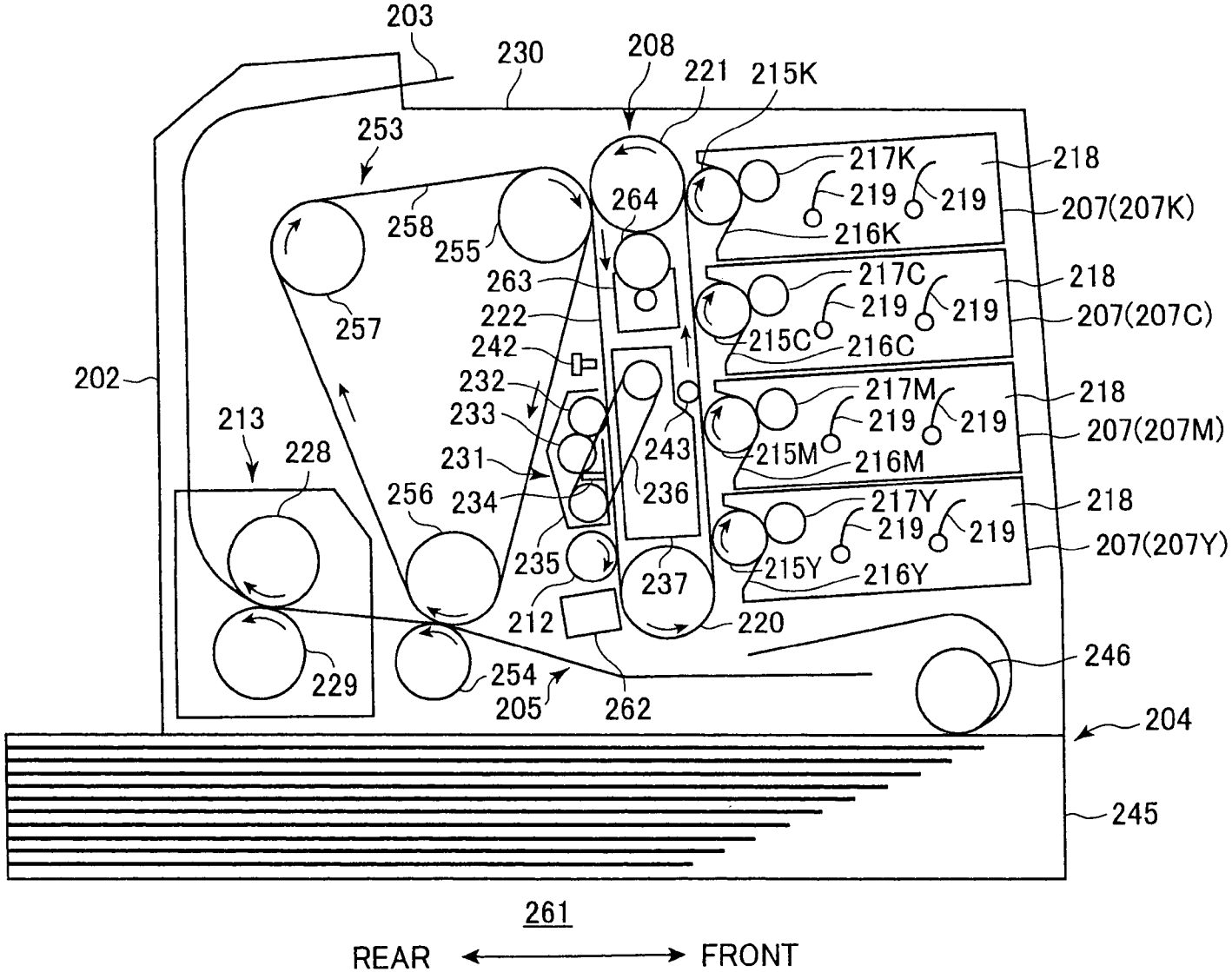
FIG. 3 is a cross-sectional view showing a color LED printer according to a third embodiment of the present invention.

The photosensitive belt mechanism 308 has the same configuration as the photosensitive belt mechanism 308 of FIG. 3, and includes a photosensitive belt 322 that circulates in the counterclockwise direction around a photosensitive belt support roller 320 and a photosensitive belt drive roller 321.

The photosensitive belt 322 moves on the same side as the fixing unit 312 downward in the same direction as the developing roller 315 of the black developing cartridge 317K at the nip portion between the photosensitive belt 322 and the developing roller 315 of the black developing cartridge 317. On the other hand, the photosensitive belt 322 moves on the opposite side from the fixing unit 312 upward in the same direction as the developing rollers 315 of the other developing cartridges 307C, 307M, and 307Y at the nip portion between the photosensitive belt 322 and the developing rollers 315 of the other developing cartridges 307C, 307M, and 307Y.

The intermediate transfer belt mechanism 353 is disposed below the black developing cartridge 307K and to the rear of the photosensitive belt mechanism 308. The intermediate transfer belt mechanism 353 has the same configuration as the intermediate transfer belt mechanism 253 of FIG. 3 and includes an intermediate transfer belt drive roller 355, a first intermediate transfer belt support roller 356, a second intermediate transfer belt support roller 357, and an intermediate transfer belt 358. The intermediate transfer belt 358 is wrapped around the three rollers 355, 356, 357.

The intermediate transfer belt drive roller 355 is positioned in confrontation with the photosensitive belt 322 at a position downstream from the photosensitive belt drive roller 321, with the intermediate transfer belt 358 sandwiched therebetween. The first intermediate transfer support roller 356 is positioned diagonally below and to the rear of the intermediate transfer belt drive roller 355. The first intermediate transfer support roller 356 is disposed in confrontation with a transfer roller 354, with the intermediate transfer belt 358 sandwiched therebetween. The second intermediate transfer support roller 357 is disposed to the rear of and above the first intermediate transfer support roller 356.

The rollers 355, 356, 357 are disposed to define an imaginary triangle. The intermediate transfer belt 358 is wrapped around the rollers 355, 356, 357. Drive force of the intermediate transfer belt drive roller 355 conveys the intermediate transfer belt 358 in a circulating manner around the outer periphery of the rollers 355, 356, 357, following the clockwise direction. By this, the intermediate transfer belt 358 moves in the same direction as the photosensitive belt 322 at the nip portion between the intermediate transfer belt 358 and the photosensitive belt 322, near the intermediate transfer belt drive roller 355.

The transfer roller 354 has the same configuration as the transfer roller 254 of FIG. 3 and is disposed so as to contact the surface of the intermediate transfer belt 358 at a position below and in confrontation with the first intermediate transfer belt roller 356, with the intermediate transfer belt 358 sandwiched between the transfer roller 356 and the intermediate transfer belt 358. The transfer roller 354 rotates counterclockwise so as to move in the same direction as the intermediate transfer belt 358 at the nip portion between the transfer roller 354 and the intermediate transfer belt 358. A predetermined transfer bias is applied between the transfer roller 354 and the intermediate transfer belt 358.

A charge roller 312 is provided with the same configuration as the charge roller 212 of the third embodiment. The charge roller 312 is positioned near to and upstream from the photosensitive belt support roller 320 with respect to the movement direction of the photosensitive belt 322, so as to contact the surface of the photosensitive belt 322. The charge roller 312 rotates clockwise and moves in the same direction as the photosensitive belt 322 at the nip portion between itself and the photosensitive belt 322.

After the surface of the photosensitive belt 322 is positively charged uniformly by the charging roller 312, the surface of the photosensitive belt 322 is exposed by the LED array 362 to form an electrostatic latent image based on image data. Contact between the photosensitive belt 322 and the developing roller 315 of one of the certain developing cartridge 307 develops the electrostatic latent image into a monochromatic visible image of the color contained in that developing cartridge 307. The monochromatic visible image is then transferred on the intermediate transfer belt 358 when the monochromatic visible image is brought into confrontation with the intermediate transfer belt 358. The monochromatic visible images in the different colors are transferred one on top of the other onto the intermediate transfer belt 358 to form a multicolored image.

In other words, first a yellow visible image is formed on the photosensitive belt 322 with the toner contained in the yellow developing cartridge 307Y, which is in the lowermost position of the developing cartridge stack. Then, when movement of the photosensitive belt 322 moves the yellow visible image into confrontation with the first transfer roller 309, the yellow visible image is transferred to the second transfer belt 327. Then, an electrostatic latent image is again formed on the photosensitive belt 322 and a magenta visible image is formed on the photosensitive belt 322 from the toner contained in the magenta developing cartridge 307M, which is the second from the lowest developing cartridge in the stack. When the magenta visible image is moved into confrontation with the intermediate transfer roller 358, the magenta visible image is transferred onto the intermediate transfer roller 358 in an overlapping manner onto the yellow visible image.

The operations described above are repeated for the cyan toner contained in the cyan developing cartridge 307C. Then, the operations described above are repeated for the black toner contained in the black developing cartridge 307K. Therefore, a multicolor image is formed on the intermediate transfer belt 358.

The multicolor image formed on the intermediate transfer belt 358 is transferred on a sheet 3 in a single transfer action, as the sheet 3 passes between the intermediate transfer belt 358 and the transfer roller 354.

The color LED printer 371 further includes a belt cleaner 331 and a charge removing lamp 342 with the same configuration as the belt cleaner 231 and the charge removing lamp 242 of the third embodiment. The belt cleaner 331 is located over the charging roller 312 at the same side of the photosensitive belt 322 as the black developing cartridge 307K. The charge removing lamp 342 is disposed in confrontation with the photosensitive belt 322 at a position downstream from the intermediate transfer belt 358, and upstream from the belt cleaner unit 331, with respect to the movement direction of the photosensitive belt 322.

A fixing unit 313 is provided with the same configuration as the fixing unit 213 of the third embodiment. The fixing unit 313 is disposed to the rear of the transfer roller 354 on the opposite side of the photosensitive belt mechanism 308 than the other three developing cartridges 307C, 307M, and 307Y. Sheets 3 that have a multi-color image thermally fixed thereon by the fixing unit 313 are discharged onto a discharge tray 330 formed at the upper portion of the housing 303.

A motor 374 is provided for driving the intermediate transfer belt drive motor 355. The motor 374 is disposed within the loop of the intermediate transfer belt 358 of the intermediate transfer belt mechanism 353 at a position near the intermediate transfer belt drive roller 355. The motor 374 drives rotation of the intermediate transfer belt drive roller 355 so that the intermediate transfer belt 358 moves. By locating the motor 374 within the loop of the intermediate transfer belt 358, the space within the loop of the intermediate transfer belt 358 can be effectively utilized so that that the printer 371 can be made smaller. It should be noted that the printers of the other embodiments can also be modified to locate a motor for driving the transfer belt roller within the loop of the transfer belt to make the printers more compact. Also, the printer 1 of the first embodiment can be modified so that the first transfer roller 9 is replaced with a mechanism having the same configuration as the second transfer belt mechanism 10, and the second transfer belt mechanism 10 is replaced with a mechanism having the same configuration as the first transfer roller 9. In this case, the motor for driving the first belt roller can be disposed within the loop of the first transfer belt so that the printer 1 can be made more compact.

The printer 371 can be made shorter by an amount equivalent to how the developing cartridges 307 are distributed on either side of the photosensitive belt mechanism 308. That is, in the present embodiment, the printer 371 can be made shorter by an amount equivalent to the black developing cartridge 307K because the four developing cartridges 307 are not stacked on top of each other, and instead the black developing cartridge 307K is disposed on one side of the photosensitive belt mechanism 308 and the other developing cartridges 307C, 307M, and 307Y are disposed on the other side of the photosensitive belt mechanism 308. The printer 371 can also be made smaller because the developing roller 315 of the black developing cartridge 307K and also the photosensitive belt 322 move downward at the nip portion and the other three developing cartridges 307C, 307M, and 307Y and the fixing unit 313 are disposed on opposite sides of the photosensitive belt mechanism 308. Further the printer 371 can be made that much smaller because all of the developing rollers 315 rotate in the same direction as the photosensitive belt 322 where they contact the photosensitive belt 322. Therefore, even higher quality images visible can be formed from toner supplied by the developing rollers 315.

As shown in two-dot chain line in FIG. 4, the printer 371 can be provided with a cover 373 for selectively closing and opening up an opening in the top of the housing 302. The cover 373 is pivotably supported on the front end of the housing 302. The black developing cartridge 307K and the cyan developing cartridge 307C, which are the developing cartridges 307 that are located at the highest positions, are disposed adjacent to the cover 373. By opening the cover 373, the black developing cartridge 307K and the cyan developing cartridge 307C can be easily removed. In this way, the cover 373 facilitates exchange operations for the black developing cartridge 307K and the cyan developing cartridge 307C, so that maintenance can be efficiently performed.

Next, a color LED printer 472 according to a fifth embodiment of the present invention will be described with reference to FIG. 5. In the description of the color laser printer 472, components that have corresponding components in the printer 261 will be referred to using reference numbers of the corresponding components added with 100. The color LED printer 472 of the fifth embodiment has substantially the same configuration as the color LED printer 371 of the fourth embodiment, except that developing rollers 415 of the other developing cartridges 407C, 407M, and 407Y rotate in the opposite direction than the developing rollers 315 of the fourth embodiment.

Explained in greater detail, the yellow developing cartridge 407Y is in the lowermost position of the stack of the other developing cartridges 407C, 407M, and 407Y. Then comes the magenta developing cartridge 407M and the cyan developing cartridge 407C in this order, with the cyan developing cartridge 407C disposed in the upper position of the developing cartridge stack. The developing cartridges 407 have the same configuration as the developing cartridges 207 of FIG. 2, that is, the developing rollers 415 rotate in the counterclockwise direction to move downward at the nip portion where the developing rollers 415 contact the photosensitive belt 422.

In the same manner as the printer 371, the printer 471 can be made shorter by an amount equivalent to how the developing cartridges 407 are distributed on either side of the photosensitive belt mechanism 408. The printer 471 can also be made smaller because the other three developing cartridges 407C, 407M, and 407Y and the fixing unit 413 are disposed on opposite sides of the photosensitive belt mechanism 408. Moreover, the developing roller 415 of the black developing cartridge 407K move in the same direction as the photosensitive belt 422 at the nip portion. However, the developing rollers 415 of the other three developing cartridges 407C, 407M, and 407Y move in the opposite direction of the photosensitive belt 422 at the nip portion. This enables selectively positioning the developing cartridges 407 so that even better quality visible images can be formed from the toner supplied from the developing rollers 415.

A motor 474 is provided for driving the intermediate transfer belt drive motor 455. The motor 474 is disposed within the loop of the intermediate transfer belt 458 and so produces the same effects as the motor 374 of the fourth embodiment.

Figure 5:
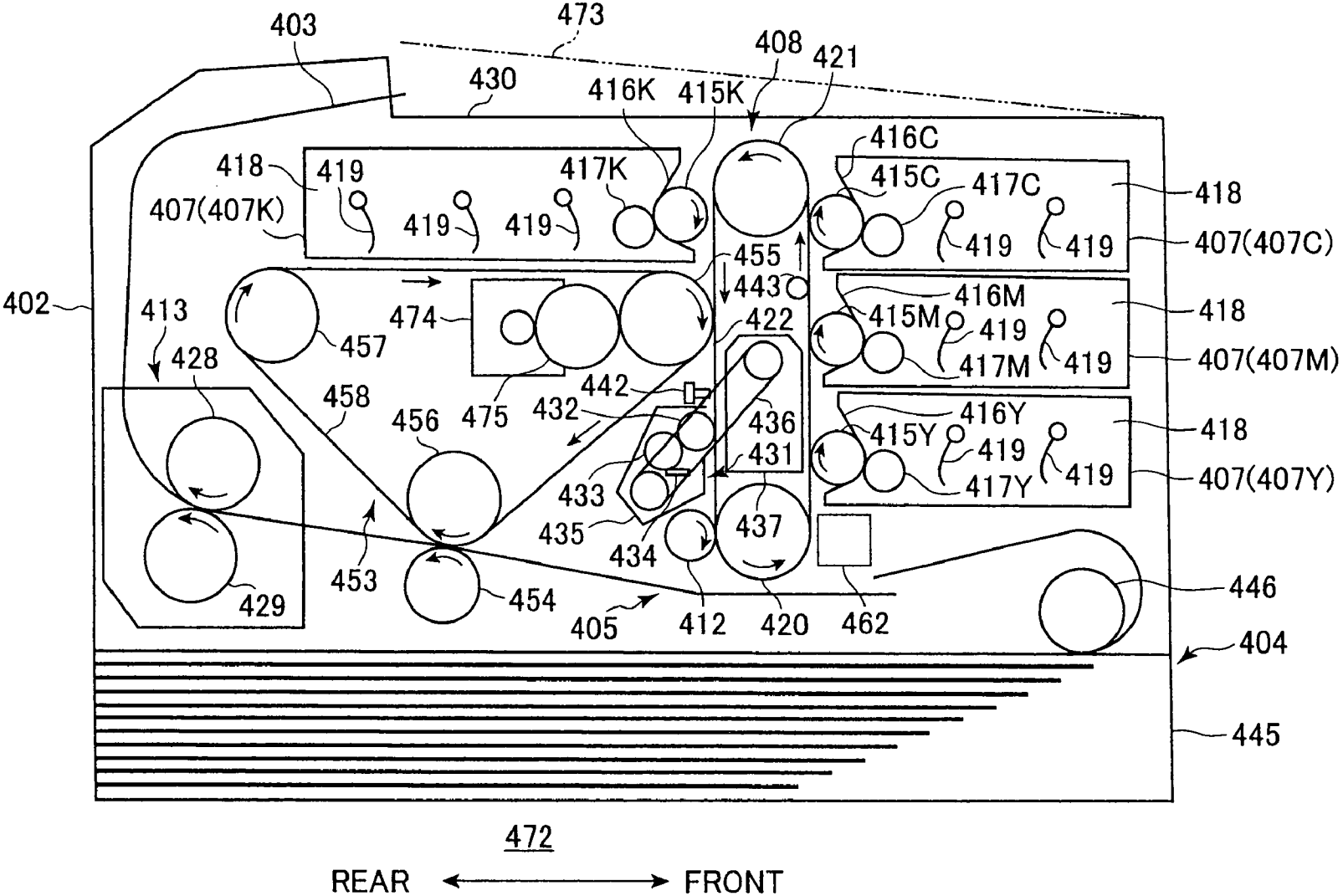
FIG. 5 is a cross-sectional view showing a color LED printer according to a fifth embodiment of the present invention.

As shown in two-dot chain line in FIG. 5, the printer 472 can be provided with a cover 473 for selectively closing and opening up an opening in the top of the housing 402, in the same manner as the printer 371. The same effects as the cover 373 can be achieved.

It should be noted that the scanner unit 6 of the first embodiment can be replaced with an LED array interposed between the photosensitive belt mechanism 8 and either the first transfer roller 9 or second transfer belt mechanism 10.

What is claimed is:

1. A color image forming device compromising:

a photosensitive unit including a photosensitive member with a photosensitive layer;

an exposing unit that exposes the photosensitive layer based on a multi-color image to form a series of latent images on the photosensitive member;

a plurality of developing units each including a developing-agent bearing member that is configured to be disposed in contact with the photosensitive member, the developing-agent bearing members including at least one developing-agent bearing member that is disposed on one side of the photosensitive member and at least one developing-agent bearing member that is disposed on the opposite side of the photosensitive member, the photosensitive member and the developing-agent bearing member that is disposed on the opposite side of the photosensitive member both moving upward at positions where the photosensitive member and the developing-agent bearing member that is disposed on the opposite side of the photosensitive member contact each other, each developing-agent bearing member bearing thereon a different color developing agent and supplying the developing agent to the photosensitive member to develop corresponding latent images into different-colored monochrome visible images;

an intermediate transfer belt that receives different-colored monochrome visible images one at a time from the photosensitive member in an overlapping manner to bear a multi-color image, the intermediate transfer belt transferring the multicolor image onto a recording medium; and a fixing unit that fixes the multi-color image onto the recording medium, the fixing unit being disposed to one side of the photosensitive member, wherein the photosensitive member and the developing-agent bearing member that is disposed on the same side of the photosensitive member as the fixing unit both move downward where the photosensitive member and the developing-agent bearing member that is disposed on the same side as the fixing unit contact each other.

2. A color image forming device as claimed in 1, further comprising:

a housing with an opening at its top; and a cover that closes up and opens up the opening in the top of the housing, an upper-most one of the developing-agent bearing members being disposed in confrontation with the cover.

3. A color image forming device as claimed in claim 1, wherein the photosensitive member is a photosensitive belt and further comprising a drive source that drives the photosensitive belt, the drive source being disposed within a loop portion of the photosensitive belt.

4. A color image forming device as claimed in claim 1, further comprising a drive source that drives the intermediate transfer belt, the drive source being disposed within a loop portion of the intermediate transfer belt.

5. A color image forming device as claimed in claim 1, wherein the photosensitive member is a photosensitive belt and further comprising a housing with an opening at top, the photosensitive belt being adapted so as to be detachable through the opening in the housing, the intermediate transfer belt being adapted to separate away from the photosensitive belt while the photosensitive belt is being detached.

6. A color image forming device compromising:

a photosensitive unit including a photosensitive member with a photosensitive layer;

an exposing unit that exposes the photosensitive layer based on a multi-color image to form a series of latent images on the photosensitive member;

a plurality of developing units each including a developing-agent bearing member that is configured to be disposed in contact with the photosensitive member, the developing-agent bearing members including at least one developing-agent bearing member that is disposed on one side of the photosensitive member and at least one developing-agent bearing member that is disposed on the opposite side of the photosensitive member, the photosensitive member moving upward and the developing-agent bearing member that is disposed on the opposite side of the photosensitive member moving downward at positions where the photosensitive member and the developing-agent bearing member that is disposed on the opposite side of the photosensitive member contact each other, each developing-agent bearing member bearing thereon a different color developing agent and supplying the developing agent to the photosensitive member to develop corresponding latent images into different-colored monochrome visible images;

an intermediate transfer belt that receives different-colored monochrome visible images one at a time from the photosensitive member in an overlapping manner to bear a multi-color image, the intermediate transfer belt transferring the multicolor image onto a recording medium; and a fixing unit that fixes the multi-color image onto the recording medium, the fixing unit being disposed to one side of the photosensitive member, wherein the photosensitive member and the developing-agent bearing member that is disposed on the same side of the photosensitive member as the fixing unit both move downward where the photosensitive member and the developing-agent bearing member that is disposed on the same side as the fixing unit contact each other.

7. A color image forming device as claimed in 6, further comprising:

a housing with an opening at its top; and a cover that closes up and opens up the opening in the top of the housing, an upper-most one of the developing-agent bearing members being disposed in confrontation with the cover.

8. A color image forming device as claimed in claim 6, wherein the photosensitive member is a photosensitive belt and further comprising a drive source that drives the photosensitive belt, the drive source being disposed within a loop portion of the photosensitive belt.

9. A color image forming device as claimed in claim 6, further comprising a drive source that drives the intermediate transfer belt, the drive source being disposed within a loop portion of the intermediate transfer belt.

10. A color image forming device as claimed in claim 6, wherein the photosensitive member is a photosensitive belt and further comprising a housing with an opening at top, the photosensitive belt being adapted so as to be detachable through the opening in the housing, the intermediate transfer belt being adapted to separate away from the photosensitive belt while the photosensitive belt is being detached.

* * * * *